United States Patent [19]

Stoiber

[11] 4,074,846

[45] Feb. 21, 1978

[54] FLOATING EYELET INSERTING TOOL

[75] Inventor: Alto Stoiber, Elgin, Ill.

[73] Assignee: Hammond Corporation, Chicago, Ill.

[21] Appl. No.: 644,297

[22] Filed: Dec. 24, 1975

[51] Int. Cl.[2] ..... B21J 15/10

[52] U.S. Cl. ..... 227/51; 227/153

[58] Field of Search ..... 227/51, 61, 62, 153

[56] References Cited

U.S. PATENT DOCUMENTS

| | | | |
|---|---|---|---|
| 2,306,851 | 12/1942 | Ward | 227/62 |
| 3,474,947 | 10/1969 | Readyhough | 227/153 |
| 3,543,985 | 12/1970 | Adolphi | 227/153 |
| 3,847,321 | 11/1974 | Charlez | 227/153 |

*Primary Examiner*—Granville Y. Custer, Jr.

*Attorney, Agent, or Firm*—Neuman, Williams, Anderson & Olson

[57] ABSTRACT

A machine to insert and stake rivets in a flexible sheet is disclosed. The machine includes a riveting punch and an associated anvil and, in cooperation therewith a clamping device having parts which float relative to the riveting punch and the anvil so that during insertion and staking of the rivet, the sheet, and more particularly the opening in the sheet for receiving the rivet can be adequately supported at a variety of distances relative to the midpoint between the riveting punch and anvil. The clamping device includes a frame carried by the punch and a sleeve carried by the anvil which cooperate to clamp the flexible sheet; and the frame and sleeve are resiliently associated with the punch and the anvil such that portions of the riveting motion of the press will cause clamping prior to riveting.

7 Claims, 7 Drawing Figures

FLOATING EYELET INSERTING TOOL

BACKGROUND OF THE INVENTION

The field of the invention is improved machines for riveting, staking, or the like including means for supporting a flexible sheet such as a ceramic, phenolic, or glass filled epoxy printed circuit board during the process of inserting and staking a rivet or other fastening device, more specifically, the supporting means is especially adapted to support the area about a rivet receiving opening without subjecting the circuit board to destructive bending loads. It has been a problem with thin sheets of brittle material which are used for electronic circuit boards (particularly those having thin films for circuit components) to adequately support them during a riveting operation without damaging or distorting them. Moreover, varying ambient conditions, residual stresses, and other processing variables may create warpage and dimensional errors which vary circuit board to circuit board. In a riveting operation, sheet warpage is a particularly troublesome problem since supporting a warped board requires an adaptable clamping device.

Machines are available which automatically position a circuit board transverse to the axis of reciprocable riveting apparatus and with holes in the board in alignment with the punch and anvil of such riveting apparatus by means of computer or numerical control. That is to say that, the circuit boards are automatically moved and aligned with the axis of a riveting punch and anvil so that each rivet-receiving-opening can be automatically filled in sequence. Because circuit boards may be warped and may already have other components carried thereon, the automatic machines support the boards at their edges and the punch and anvil are held apart from each other during transportation of the board to avoid interference with the installed components. Consequently, it is impractical to provide significant support at or near the rivet receiving openings until clamping just prior to riveting.

SUMMARY OF THE INVENTION

The subject of the invention seeks to overcome the problems discussed above.

Accordingly, it is an object of the present invention to provide an improved support for holding a circuit board during riveting, and for accommodating the flexibility and warpage of the board.

It is another object of the present invention to provide an improved riveting machine with a floating clamping device which is sufficiently yieldable to function with warped dimensionally variable and flexible electronic circuit boards.

It is a further object of the present invention to provide structure for clamping which engages and holds a flexible circuit board and which includes lost motion linkage to accommodate warpage and dimensional variations in such boards.

In carrying out the invention, a machine tool apparatus is provided including a riveting apparatus equipped to feed rivets to a punch and anvil for insertion and staking. An automatic mechanism is provided to position a circuit board between the punch and anvil and in alignment therewith for receiving rivets. The punch consists of an elongated pin for driving a rivet and a clamping frame for engaging the insertion side of a circuit board. The frame is suspended from the punch by a pair of compression springs which permit the frame to have limited compliance with a warped circuit board and lost motion relative to the punch. Opposite the pin and frame is an anvil which carries a yieldably supported sleeve-like mandrel; the mandrel is designed to oppose from the opposite or receiving side of the board the force of the aforesaid frame. The sleeve-like mandrel is concentrically carried by the anvil on a compression spring provided for complying with warpage of a circuit board and for cooperating with the suspended frame during the steps of the process of inserting and staking.

DESCRIPTION OF THE PREFERRED EMBODIMENT

Figure 1:
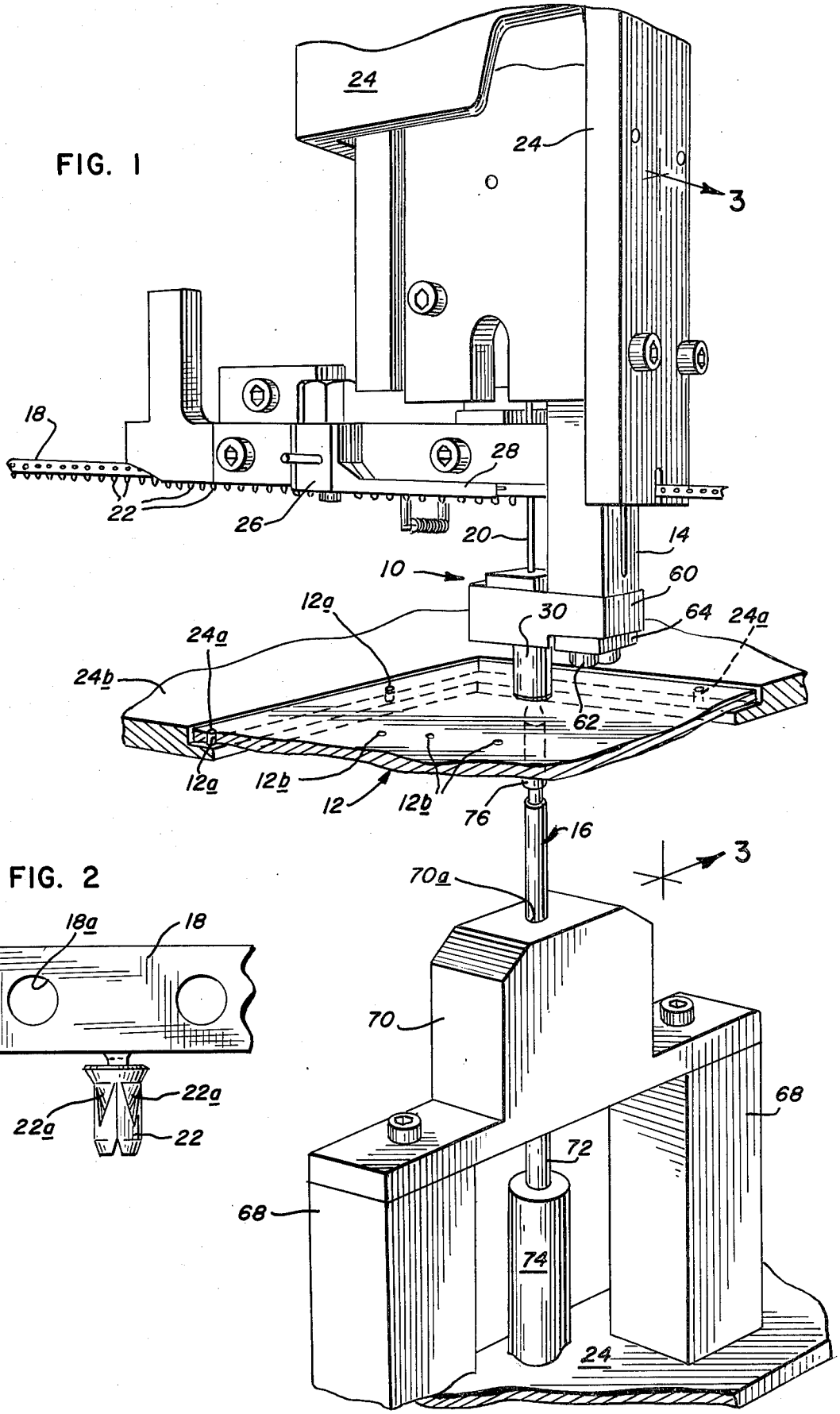
FIG. 1 is a partial perspective view of a machine tool for inserting and staking rivets into a flexible electronic circuit board, the tool being shown with the punch and anvil in the actuated position.
Figure 2:
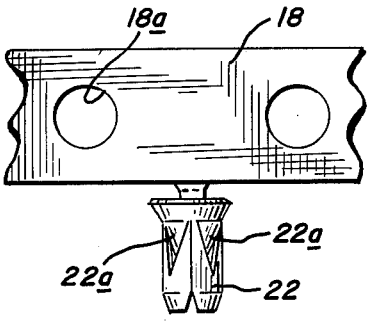
FIG. 2 is an enlarged front elevational view of a fragment of the feed strip for rivets with one rivet of the particular hollow type used in connection with the machine tool of FIG. 1.

In FIG. 1 there is shown a riveting tool 10 for supporting a flexible sheet 12 between a rivet feeding and inserting portion 14 and a staking anvil 16. The term "flexible sheet" refers to such materials as printed circuit boards which are not completely rigid and dimensionally stable, but can be bent, distorted, or subject to warpage. The circuit board 12 may have an etched circuit and a series of holes for receiving components and connectors for components. The tool 10 is designed to insert a special hollow or eyelet rivet 22 in the nature of a solderless connector in the board 12. A supply of special rivets 22 are individually carried on a perforated tape 18 past a punch pin 20 located on the portion 14. The tape 18, a segment of which is best shown in FIG. 2; includes hollow rivets 22 such as a Griplet rivet sold by the Berg Electronics Division of Dupont de Nemours. The Griplet rivet has inwardly turned barbs **22*a* for catching and retaining a piece of electrical wire. That is to say that when such a rivet is inserted and staked in a circuit board, the barbs being angled prevent the removal of a wire inserted into the hollow center of the rivet. The punch portion 14, staking anvil 16 and the flexible board 12 are all carried on a common chassis 24 which supports the punch portion 14 in alignment with the staking anvil 16 and holds the flexible board 12** in a plane transversely therebetween.

There is a rivet feeding mechanism 26 shown in FIG. 1 for feeding the tape 18 past the punch pin 20 by means of perforations 18*a*. Mechanism 26 includes pivotal arm 28 which is supported on the side of the chassis 24 near punch portion 14. As the punch portion 14 moves up and down, the arm 28 moves in a trigger-fashion and acts like a kicking pawl for advancing the tape 18 so that the hollow rivet 22 will be in alignment with the punch pin 20 at the appropriate time. As will be explained herein, the punch pin 20 picks a rivet 22 off of the tape 18 and delivers it into a punch and rivet guiding means 30, shown in FIG. 3. The punch and rivet guiding means 30 includes a hollow internal well 31 which supports therein a split collar 34 having an enlarged cylindrical top or rivet receiving end 34*a* and a necked down bottom section or rivet dispensing end 34*b*. A compression spring 36 which at its bottom bears against the lower end of well 31 and at its top bears against a shoulder 34*c* on the collar 34 resiliently supports split collar 34 for sliding reciprocal movement within well 31. The rivet receiving portion 34*a* is enlarged to fit the well 31, such that the spring 36 may ride freely and concentrically about the necked down section 34*b* of collar 34 without interfering with well 31. A short bore 37 connects the bottom of the well 31 to the bottom of the guiding means 30, see FIG. 3. The bore 37 has an inside diameter which is substantially identical to the outside diameter of the collar 34 at section 34*b* such that the collar 34 is guided thereby in bearing fashion at its lower end near section 34*b* and is brushed in a similar fashion by the enlarged diameter of well 31 at the other end or rivet receiving portion 34*a*. The inner diameter of the split collar 34 is just slightly smaller than the maximum diameter of a rivet 22*a* but, however, the split in the collar 34 causes it to operate as a collet whereby the rivet is held by a light frictional force during its transportation through guide means 30 and the split collar 34 therein.

Figure 3:
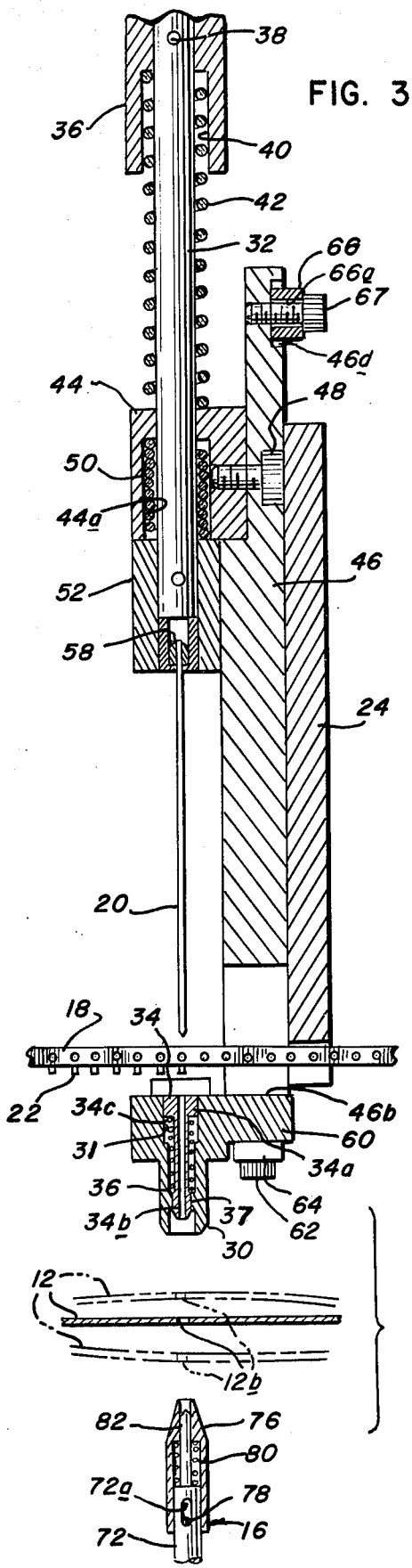
FIG. 3 is a fragmentary side elevational view shown in cross section, of the punch and anvil for feeding, inserting and staking rivets in an electronic circuit board with a board illustrated under three alternative possible conditions. The pin of the punch is shown in an initial deactuated position.

To drive the rivets 22 through the collar 34 there is an elongated punch pin 20 which is mounted for reciprocal movement relative to chassis 24. As shown in FIG. 3, there is a drive rod 32 which bears agains the upper end of drive pin 20 whereby the punching force is transmitted from rod 32 to pin 20. The drive rod 32 is moved by means of a connecting rod 35 and connected drive block 36 which are propelled by a riveting press air cylinder, as is common in the art and is therefore not shown. The connecting rod 35 and the drive rod 32 are movably connected to the drive block 36 by transversely mounted removably retaining pins 38 in a sort of hinged fashion. Thus, an easily detached connection is formed between the drive rod 32 and the connecting rod 35. The bottom of drive block 36 has an enlarged concentric bore 40 which opens downwardly and surrounds the drive rod 32. The bore 40 retains and guides an upper compression type coil spring 42 positioned concentrically about the drive rod 32. Spring 42 extends from the bore 40 downwardly along the drive rod 32. The lower end of upper coil spring 42 rests upon the bottom of an inverted cup 44 through which drive rod 32 passes, see FIG. 3. The position of cup 44 is a function of the compression of spring 42. Cup 44 is attached to an elongated frame 46 by means of an Allen screw 48 so that cup 44 and frame 46 move together as a unit. The well 44*a* of cup 44 opens downwardly and provides a space for receiving, retaining and guiding lower compression type coil spring 50 mounted therein and carried concentrically about the part of the drive rod 32 where it pokes beneath cup 44. The mounting is in a manner similar to the way in which upper spring 42 is mounted concentrically about the upper part of drive rod 32 within bore 40. The bottom end of lower spring 50 bears against a coupling block 52 which also receives the bottom end of the drive rod 32. Drive rod 32 is held in coupling block 52 by a transversely positioned pin 54. Coupling block 52 has a bore therethrough for receiving the drive rod 32 and for holding punch pin 20 in retaining socket 56, immediately beneath the end of rod 32. Retaining socket 56 is held in coupling block 52 by a set screw (not shown) in a well known manner. Retaning socket 56 is generally hollow and includes an inwardly direct annular flange 56*a* at the bottom thereof. The hollow of socket 56 forms a retaining pocket and the punch pin 20 is hung directly through the opening in flange 56*a*, by means of an enlarged retaining knob 58 formed on the top of punch pin 20. Retaining knob 58 has the outer diameter slightly smaller than the inner diameter of socket 56 so that the drive pin 20 is captured for movement with rod 32, but however limited axial motion is permitted between the pin 20 and the socket 56 by means of slight axial clearance provided in socket 56 between the top of knob 58 and the bottom of rod 32.

Frame 46 is suspended by springs 42 amd 50 upon drive rod 32 such that movement of rod 32 causes related movement of frame 46 by means of which the springs 42 and 50 coact as a permissive double-acting lost motion linkage between the drive rod 32 and the frame 46. Elongated frame 46 extends from its connection with cup 44 downwardly and parallel to the drive rod 32, the coupling block 52 and the punch pin 20 whereby the coupling block 52 rides upon a flat vertical surface 46*a* of frame 46. Attached to the lowermost distal portion 46*b* of frame 46 is the punch and guiding means 30 held by a mounting block 60 fastened to portion 46*b* by Allen screws 62 and a cooperating washer 64, see FIG. 1. As explained above, the guiding means 30 supports the split collar 34 in axial alignment with punch pin 20.

Figure 5:
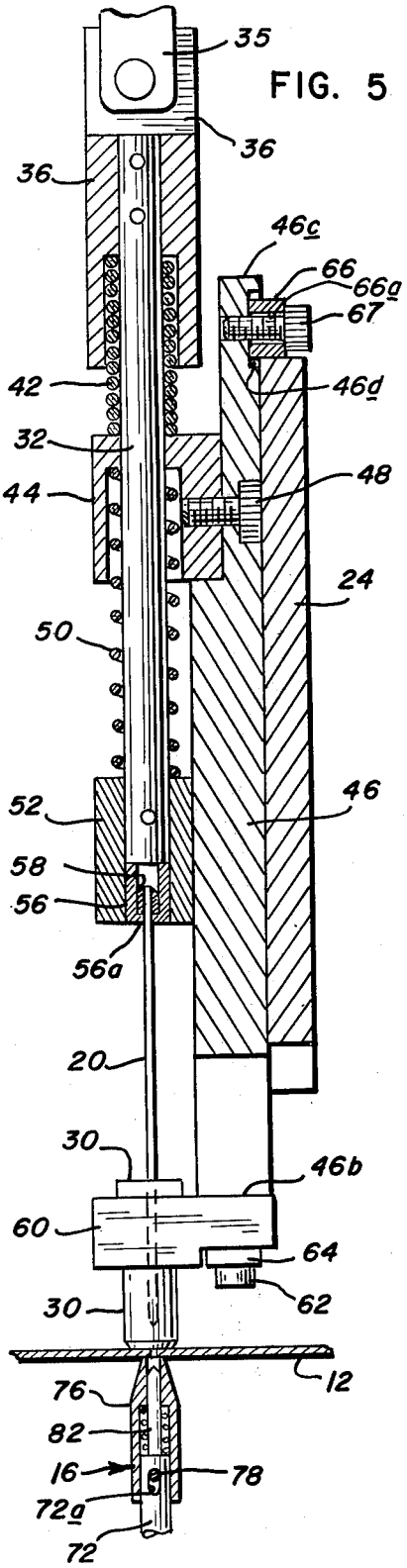
FIG. 5 is a fragmentary side elevational view shown partly in cross section similar to FIG. 4, except that the board is shown clamped between the punch frame and the anvil sleeve such that warpage of the board has been overcome.

At the upper end 46*c* of elongated frame 46 is an adjustable stop block 66 held by an Allen screw 67. Stop block 66 has a slotted hole 66*a* for screw 67 so that the position of stop block 66 can be adjusted within enlarged recess 46*d* in frame 46. Stop block 66 is provided to limit downward movement of elongated frame 46 to a predetermined distance. As shown in FIG. 5 block 66 contacts a portion of chassis 24 preventing further downward motion of frame 46. The stop block 66 is adjusted so that the bottom of guide meams 30 does not pass the plane in which a perfectly flat (unwarped) circuit board 12 would lie when carried by the machine for the riveting tool 10.

The circuit board 12, as shown in FIG. 1, is supported by its edges on a movable table portion 24*b* of the main chassis 24, and the board 12 has holes 12*a* at its edges which accept mounting pins 24*a* so that the board can be moved in a plane transverse to the punch portion 14 and the anvil 16. As is common with automatic component inserting equipment, a computer controlled mechanism automatically moves table 24*b* and the circuit board 12 with respect to the axis of the punch and anvil whereby the axis may be automatically abd sequentially brought into alignment with each of the rivet receiving openings 12*b* in the circuit board 12. The United Shoe Machine Company makes a computer controlled component inserting machine system 7000, and the tool 10 disclosed herein is designed to be used with that system. However, it should be understood that the tool 10 could also be used with a Berg pantograph system.

The anvil 16 is supported on chassis 24 by a pair of upright pedestals 68 which carry a horizontally disposed bearing block 70 having a vertical bore 70*a* through which the anvil shaft 72 passes. At the lower end of shaft 72 between pedestals 68 is the connection 74 to an air cylinder (not shown) for reciprocally moving the anvil shaft 72. The working end of the anvil 16 is carried at the upper end of shaft 72, see FIGS. 5, 6 and 7. For supporting the circuit board 12 and cooperating with guide means 30 to restrain the board 12 during the insertion and the staking of a rivet 22 there is an anvil mandrel 76 which is sleeve-like in shape for fitting circumannuarly about shaft 72 and extending therefrom. The mandrel 76 is retained on shaft 72 by means of a pin 78 positioned transverse to the axis of the shaft 72. Pin 78 is horizontally disposed within a vertically elongated slot 72*a* so that the pin 78 and the anvil mandrel 76 can move vertically with respect to the shaft 72. A compression type coil spring 80 is held between the end of the shaft 72 and the mandrel 76. The lower end of coil spring 80 bears against the top or distal face 72*b* of shaft 72 and the upper end of coil spring 80 bears against a shoulder 76*a* on the inside of mandrel 76. The spring 80 forces the mandrel upwardly to extend away from the shaft 72.

There is an elongated cylindrical anvil stake 82 having a conically-shaped point 82*a*, the apex of which is aligned axially with the punch pin 20 and is extended upwardly from the center of distal face 72*b* of shaft 72. Stake 82 fits within the coil spring 80. The mandrel 76 is normally held in an extended position such that the staking tip 82*a* is lodged within the hollow of the sleeve-like mandrel 76. When the shaft 72 is brought upwardly to engage the circuit board 12, the sleeve-like mandrel 76 first contacts the board and the resistance of the board compresses the spring 80 causing the mandrel sleeve 76 to stop. The staking tip 82*a*, however, proceeds until it extends slightly beyond the end of the mandrel. The extension of tip 82*a* is controlled by the height of the slot 72*a*.

Figure 4:
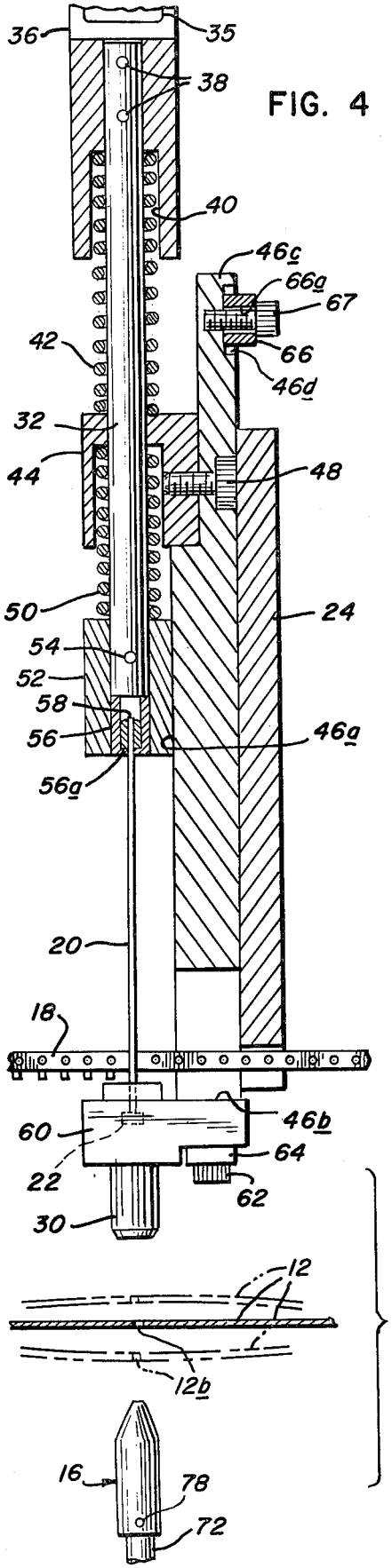
FIG. 4 is a fragmentary side elevational view shown partly in cross section similar to FIG. 3, except that the pin of the punch is shown carrying a hollow rivet towards the board.

In operation, the tool 10 operates in accordance with the sequence shown by FIGS. 3, 4, 5, 6 and 7, i.e., the tool components shown in each of the respective figures are depicted in various stages of the operations of feeding, inserting, and staking a rivet in a flexible board. In FIG. 3 the punch pin 20 is shown at its uppermost position. The upper spring 42 is shown extended and the lower spring 50 compressed due to the upward lifting force of connection rod 35 and the greater stiffness of upper spring 42 as compared to that of lower spring 50. Spring 50 carries elongated frame 46 and holds it about ⅝ inch above the circuit board 12. Similarly, the anvil 16 is held down and about ⅝ inch below board 12. FIG. 4 shows the punch pin 20 after it has been driven downwardly by the connecting rod 35. A rivet 22 has been picked from the feeding tape 18 and driven into the guide means 30. The upper spring 42 has been compressed and the lower spring 50 has been extended but frame 46 has not moved due to resisting force of spring 50. The upper compression spring 42 has a slightly greater wire diameter and, therefore, a greater spring constant K than lower spring 50. The spring constant K of the upper spring is just adequate to begin to move frame 46 after the punch pin 20 has picked a rivet 22 from the tape 18 and inserted it in the upper rivet receiving end 34*a* of collar 34.

FIG. 5 shows the tool 10 wherein the elongated frame 46 has been driven into engagement with the circuit board 12 by means of the force transmitted from connecting rod 35 to drive block 36 which forces spring 42 to push the inverted cup 44 and connected frame 46. Simultaneously therewith, the anvil 16 having sleeve-like mandrel 76 is raised by shaft 72 causing mandrel 76 to engage with the opposite side of circuit board 12. Stop block 66 then hits chassis 24 to prevent further movement of the frame 46. If circuit board 12 has an upward or downward warp, such as shown in dotted lines in FIGS. 3 or 4, the combined action of guide 30 on frame 46 and sleeve 76 on anvil 16 straightens the board and clamps it so that the eyelet 22 will be accurately driven in to the board 12.

Figure 6:
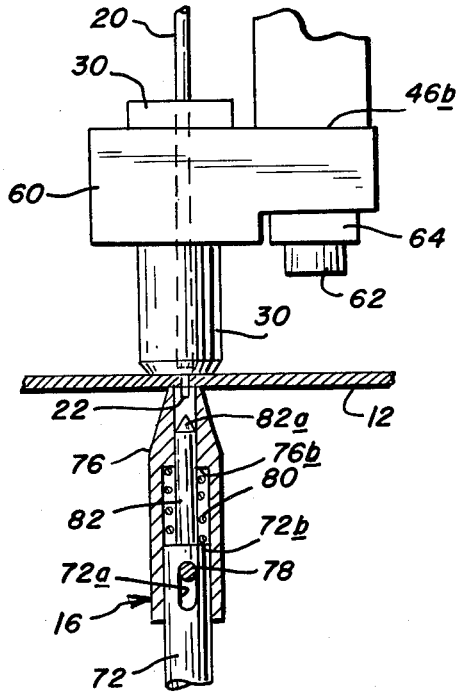
FIG. 6 is an enlarged fragmentary view shown in cross section of the punch and anvil of FIG. 5 except that the pin is shown completely extended and the rivet is fully inserted into an opening in the circuit board.
Figure 7:
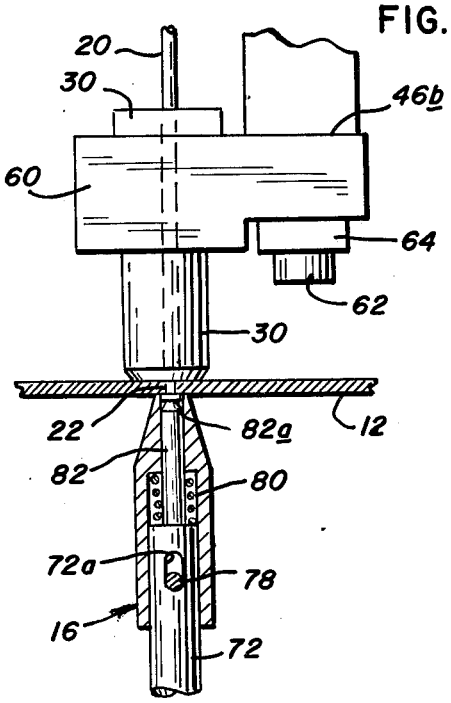
FIG. 7 is a view similar to that of FIG. 6, except that the anvil in FIG. 7 is shown staking the rivet.

FIGS. 6 and 7 shows the final operations in which the rivet 22 is inserted and staked in the circuit board 12. The operational details of the split collar 34 are shown in FIG. 3, and from FIGS. 6 and 7, it is clear that the rivet 22 is brought into position by the punch pin 20 and it is held there until shaft 72 raises the stake 82 into contact with the rivet 22. During this operation, the guide 30 and the mandrel 76 cooperate to support the circuit board 12 in the area immediately adjacent the rivet receiving opening. It has been found that by the proper selection of spring force, an adequate support for the circuit board 12 can be achieved without damage to the board, notwithstanding the flexibility and tolerance problems caused by the thinness of the board and warpage.

It should be appreciated that the size, the location, and the type of springs used may be varied from those described and illustrated for the preferred embodiment so long as there is a compliant clamping arrangement to hold the circuit board during the riveting operation. It is further to be understood that the disclosure has been made only by way of example and that any additional modifications and changes in various details may be applied to achieve the invention. Thus, it will be seen that a sturdy, simple, reliable, efficient, and economical machine tool for riveting flexible sheets has been provided, wherein the sheet is supported during the insertion and staking of a rivet.

What is claimed is:

1. Apparatus for inserting and staking rivets in a flexible sheet having at least one rivet receiving opening comprising: a chassis; reciprocable punch means movable relative to said chassis for inserting one of said rivets into said opening in said flexible sheet; anvil means reciprocably mounted on said chassis opposite said punch means and in axial alignment therewith for staking said inserted rivet; means mounted on said chassis for supporting said sheet between said punch means and said anvil means; first holding means, suspended upon said punch means and operable to move bidirectionally relative thereto, for supporting said sheet in the area adjacent said opening; resilient members connected to said punch means and said first holding means for regulating bidirectional movement of said first holding means relative to said punch means; second holding means yieldably extending from and coaxially mounted upon said anvil means for supporting said sheet in the area adjacent said opening; said first and second holding means being axially aligned and engageable with said sheet; a support plane defined as a plane perpendicular to the direction of movement of said punch means and disposed between said punch and anvil means; and said first and second holding means accommodating variations in the position of said flexible sheet in the area adjacent said opening such as variations due to warpage of the flexible sheet relative to said support plane by clamping about said rivet receiving opening in said sheet during insertion and staking of said rivet.

2. The apparatus of claim 1 wherein said punch means includes an elongated pin and drive linkage in axial alignment with said pin, said first holding means having a frame suspended by a pair of springs carried upon said linkage.

3. The apparatus of claim 2 wherein a stop means mounted on said chassis for preventing said frame from traveling past a predetermined point whereby the stress applied by said first holding means to the flexible sheet is limited.

4. The apparatus of claim 2 wherein said pair of springs permit bidirectional movement of said frame relative to said pin, forming therebetween a permissive double-acting lost motion connection allowing said frame to move relative to said pin with a portion of and said frame extending beyond the drift a rivet-engaging end of said pin preceding said pin and rivet into contact with the flexible sheet.

5. The apparatus of claim 4 therein said linkage is a cylindrical rod and said pair of springs are compression type coil springs concentrically disposed in spaced apart relation on said rod and a portion of said frame is captured between the spaced adjacent ends of said springs to transmit the rivet driving motion of said rod and said pin through one of said springs and the other of said springs transmits the motion of said rod and said pin the opposite direction.

6. The apparatus of claim 5 wherein said rivet during spring is less resilient than the other of said springs whereby the force applied to said frame to remove said frame from the flexible sheet.

7. The apparatus of claim 1 wherein said anvil means is cylindrically shaped and said second holding means is a sleeve surrounding said anvil means and a spring for resiliently carrying said sleeve concentrically upon and extending from said anvil means.

* * * * *

UNITED STATES PATENT AND TRADEMARK OFFICE

CERTIFICATE OF CORRECTION

PATENT NO. : 4,074,846

DATED : February 21, 1978

INVENTOR(S) : Alto Stoiber

It is certified that error appears in the above-identified patent and that said Letters Patent are hereby corrected as shown below:

Column 3, line 34, "brushed" should be --bushed--

Column 3, line 46, "agains" should be --against--

Column 3, line 54, "removably" should be --removable--

Column 4, line 16, "Retaning" should be --Retaining--

Column 4, line 54, "meams" should be --means--

Column 4, line 67, "abd" should be --and--

Column 6, line 41, "any" should be --many--

Claim 6, column 8, line 14, "during" should be --driving--

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*